US010801521B2

(12) United States Patent
Mochizuki et al.

(10) Patent No.: US 10,801,521 B2
(45) Date of Patent: Oct. 13, 2020

(54) HEATING DEVICE AND TURBO MOLECULAR PUMP

(71) Applicant: TOKYO ELECTRON LIMITED, Tokyo (JP)

(72) Inventors: Tsutomu Mochizuki, Miyagi (JP); Kazuhiro Chiba, Miyagi (JP); Ryo Murakami, Miyagi (JP); Kazuyuki Miura, Miyagi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 360 days.

(21) Appl. No.: 15/485,778

(22) Filed: Apr. 12, 2017

(65) Prior Publication Data

US 2017/0298958 A1 Oct. 19, 2017

(30) Foreign Application Priority Data

Apr. 14, 2016 (JP) ..... 2016-081419

(51) Int. Cl.
*F04D 19/04* (2006.01)
*F04D 29/70* (2006.01)
(Continued)

(52) U.S. Cl.
CPC ..... *F04D 29/701* (2013.01); *B08B 7/0071* (2013.01); *F04D 19/042* (2013.01); *F04D 29/325* (2013.01); *H05B 1/023* (2013.01)

(58) Field of Classification Search
CPC . B08B 7/0071; F24H 9/00; F24H 9/02; F24H 9/06; H05B 1/00; H05B 1/023;
(Continued)

(56) References Cited

U.S. PATENT DOCUMENTS 3,157,773 A * 11/1964 Pickard ..... H05B 3/06 123/142.5 E
3,652,183 A * 3/1972 Pottharst, Jr. ..... F04D 29/102 415/231

(Continued)

FOREIGN PATENT DOCUMENTS

JP 6-151365 A 5/1994
JP 2015-229936 A 12/2015

*Primary Examiner* — Charles G Freay
*Assistant Examiner* — Thomas Fink
(74) *Attorney, Agent, or Firm* — Rothwell, Figg, Ernst & Manbeck, P.C.

(57) ABSTRACT

A heating device for heating a component in a turbo molecular pump for exhausting a gas includes a heat transfer member, a heater, a first seal member and a second seal member. The heat transfer member is provided in an opening of a housing of the turbo molecular pump and has one end fixed to the component and the other end exposed to an outside. The heater in the heat transfer member heats the component through the heat transfer member. The first seal member is provided between the heat transfer member and the opening along an outer peripheral surface of the heat transfer member. The second seal member between the heat transfer member and the opening is located close to the component compared to the first seal member. The second seal member suppresses movement of radicals in a gas into a space between the heat transfer member and the opening.

6 Claims, 5 Drawing Sheets

(51) Int. Cl.
*F04D 29/32* (2006.01)
*B08B 7/00* (2006.01)
*H05B 1/02* (2006.01)

(58) Field of Classification Search
CPC ... H05B 1/0244; H05B 1/0291; F04D 29/701; F04D 29/325; F04D 29/5853; F04D 29/584; F04D 19/042
See application file for complete search history.

(56) References Cited

U.S. PATENT DOCUMENTS 3,925,203 A * 12/1975 Turner ..... B03D 1/1437 210/706
4,739,899 A * 4/1988 Thompson ..... F16J 15/062 220/240
5,924,841 A * 7/1999 Okamura ..... F04D 19/046 415/176
2002/0039533 A1* 4/2002 Miyamoto ..... F04D 19/04 417/313
2012/0207592 A1* 8/2012 Tsutsui ..... F04D 29/388 415/200
2015/0354577 A1* 12/2015 Tsutsui ..... F04D 19/042 415/90

* cited by examiner

HEATING DEVICE AND TURBO MOLECULAR PUMP

CROSS-REFERENCE TO RELATED APPLICATIONS

This application claims priority to Japanese Patent Application No. 2016-081419 filed on Apr. 14, 2016, the entire contents of which are incorporated herein by reference.

FIELD OF THE INVENTION

The disclosure relates to a heating device and a turbo molecular pump.

BACKGROUND OF THE INVENTION

A semiconductor device manufacturing process may include a processing step using a plasma. In the processing step using a plasma, a plasma of a processing gas is generated in a vacuum chamber and a predetermined processing is performed on a substrate in the vacuum chamber by ions or radicals in the plasma. The vacuum chamber is airtightly configured to obtain a predetermined vacuum level. In general, the vacuum chamber includes a plurality of components. When a gap exists between the components, the airtightness of the vacuum chamber deteriorates. Therefore, when the gap exists between the components, the gap is filled by an O-ring made of rubber or the like. Accordingly, the airtightness of the vacuum chamber is increased.

However, when the plasma is generated in the vacuum chamber, the O-ring is corroded by the ions or the radicals in the plasma. When the O-ring is corroded, the airtightness of the vacuum chamber deteriorates. Therefore, there is known a technique for providing a gas exhaust port near the O-ring (see, e.g., Japanese Patent Application Publication No. H6-151365).

Further, in the plasma processing, the processing gas in the vacuum chamber is exhausted by a gas exhaust unit such as a turbo molecular pump or the like. The processing gas exhausted from the vacuum chamber contains particles of reaction by-products which are referred to as deposits. When the deposits are adhered to the turbo molecular pump during the exhaust operation, an exhaust performance of the turbo molecular pump is decreased, which makes it difficult to maintain a pressure in the vacuum chamber to a predetermined level. Thus, the adhesion of the deposits is suppressed by heating components, to which the deposits are easily adhered, in the turbo molecular pump.

In the technique disclosed in Japanese Patent Application Publication No. H6-151365, the gas containing radicals flowing toward a gas exhaust port flows near the O-ring since the gas exhaust port is provided near the O-ring. Accordingly, the O-ring exposed to the exhaust gas is corroded by the radicals contained in the exhausted gas.

The components to which the deposits are easily adhered in the turbo molecular pump are heated by, e.g., a heating device inserted from the outside of the turbo molecular pump. Since a gap exists between the heating device and a housing of the turbo molecular pump, a O-ring is provided to suppress the deterioration of the airtightness in the turbo molecular pump. The O-ring is corroded by radicals contained in the gas flowing through the turbo molecular pump as the O-ring is exposed to the gas flowing through the turbo molecular pump.

When the O-ring is corroded, the airtightness of the vacuum chamber or that of the turbo molecular pump deteriorates. Therefore, the O-ring is exchanged. In order to exchange the O-ring, the processing apparatus needs to be stopped, which results in a decrease in a throughput of the semiconductor device manufacturing process.

SUMMARY OF THE INVENTION

In accordance with an aspect, there is provided a heating device for heating a component in a turbo molecular pump for exhausting a gas in a plasma processing apparatus. The heating device includes a heat transfer member, a heater, a first seal member and a second seal member. The heat transfer member is provided in an opening formed at a sidewall of a housing of the turbo molecular pump. The heat transfer member has one end fixed to the component and the other end exposed to an outside of the housing. The heater is provided in the heat transfer member, and configured to heat the component through the heat transfer member. The first seal member is provided in an annular shape between the heat transfer member and the opening of the housing along an outer peripheral surface of the heat transfer member. The second seal member is provided in an annular shape between the heat transfer member and the opening of the housing along the outer peripheral surface of the heat transfer member and located close to the component compared to the first seal member. The second seal member suppresses movement of radicals contained in a gas exhausted by the turbo molecular pump into a space between the heat transfer member and the opening of the housing.

In accordance with various aspects and embodiments of the disclosure, the throughput of the semiconductor device manufacturing process can be improved.

BRIEF DESCRIPTION OF THE DRAWINGS

The objects and features of the disclosure will become apparent from the following description of embodiments, given in conjunction with the accompanying drawings, in which.

DETAILED DESCRIPTION OF THE EMBODIMENTS

Figure 1:
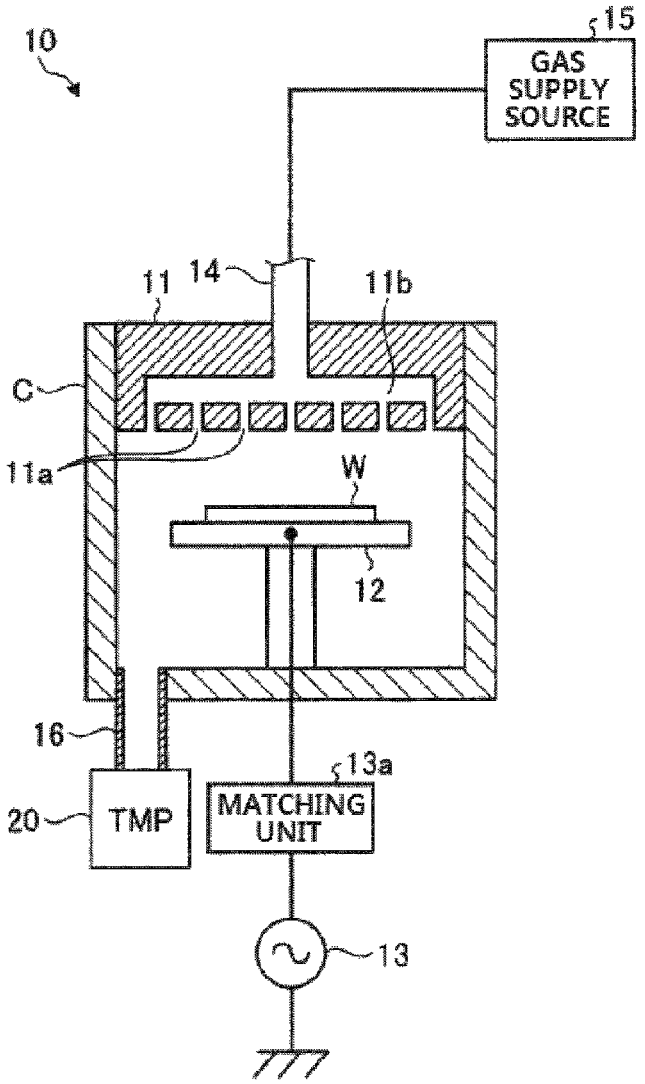
FIG. 1 shows an example of a plasma processing apparatus.

A heating device of the disclosure is a device for heating a component in a turbo molecular pump for exhausting a gas in a plasma processing apparatus. In one embodiment, the heating device includes a heat transfer member, a heater, a first seal member and a second seal member. The heat transfer member is provided in an opening formed at a sidewall of a housing of the turbo molecular pump. The heat transfer member has one end fixed to the component and the other end exposed to an outside of the housing. The heater is provided in the heat transfer member, and configured to heat the component through the heat transfer member. The first seal member is provided in an annular shape between the heat transfer member and the opening of the housing along an outer peripheral surface of the heat transfer member. The second seal member is provided in an annular shape between the heat transfer member and the opening of the housing along the outer peripheral surface of the heat transfer member and located close to the component compared to the first seal member. The second seal member suppresses movement of radicals contained in a gas exhausted by the turbo molecular pump into a space between the heat transfer member and the opening of the housing.

The second seal member may be an O-ring having a surface coated with fluorine resin.

The fluorine resin may be polytetrafluoroethylene.

The fluorine resin may be coated on the surface of the O-ring with a thickness of 0.2 mm to 0.4 mm.

The second seal member may be provided at multiple locations close to the component compared to the first seal member.

A gap may be provided between the heat transfer member and the opening of the housing. The gap is airtightly partitioned from an outer space of the housing by the first seal member, and the heater may heat the component to a temperature higher than a temperature of the housing through the heat transfer member.

The component heated by the heating device may be a screw stator in the turbo molecular pump.

A turbo molecular pump of the disclosure is a pump for exhausting a gas in a plasma processing apparatus. In one embodiment, the turbo molecular pump includes a housing, a rotor, a stator and a heating device. The rotor is rotatably provided in the housing and has a plurality of rotary blades. The stator has stationery blades alternately disposed with the respective rotary blades and a screw stator provided below the stationery blades. The heating device is configured to heat the screw stator. The heating device includes a heat transfer member, a heater, a first seal member and a second seal member. The heat transfer member is provided in an opening formed at a sidewall of a housing of the turbo molecular pump. The heat transfer member has one end fixed to a component in the turbo molecular pump and the other end exposed to an outside of the housing. The heater is provided in the heat transfer member, and configured to heat the component through the heat transfer member. The first seal member is provided in an annular shape between the heat transfer member and the opening of the housing along an outer peripheral surface of the heat transfer member. The second seal member is provided in an annular shape between the heat transfer member and the opening of the housing along the outer peripheral surface of the heat transfer member and located close to the component compared to the first seal member. The second seal member suppresses movement of radicals contained in a gas exhausted by the turbo molecular pump into a space between the heat transfer member and the opening of the housing.

Hereinafter, embodiments of a heating device and a turbo molecular pump will be described in detail with reference to the accompanying drawings. The heating device and the turbo molecular pump of the disclosure are not limited to the following embodiments.

(Example of Configuration of Plasma Processing Apparatus 10)

FIG. 1 shows an example of the plasma processing apparatus 10. The plasma processing apparatus 10 includes a substantially cylindrical chamber C having a surface made of, e.g., alumite-treated (anodically oxidized) aluminum or the like. The chamber C is grounded. A mounting table 12 is provided in the chamber C. The mounting table 12 mounts thereon a semiconductor wafer W that is a target of plasma processing.

A high frequency power supply 13 for generating a plasma is connected to the mounting table 12 via a matching unit 13*a*. The high frequency power supply 13 applies a high frequency power having a frequency of, e.g., 60 MHz, which is suitable for generating a plasma in the chamber C, to the mounting table 12. Accordingly, the mounting table 12 for mounting thereon the semiconductor wafer W also serves as a lower electrode. The matching unit 13*a* functions such that a load impedance and an internal impedance of the high frequency power supply 13 apparently match when the plasma is generated in the chamber C. Accordingly, the matching unit 13*a* matches the load impedance with the internal (or output) impedance of the high frequency power supply 13.

A shower head 11 is provided at a ceiling portion of the chamber C. The shower head 11 also serves as an upper electrode. A gas supply source 15 for supplying a gas used for plasma processing is connected to a gas inlet line 14 of the shower head 11. The gas supplied from the gas supply source 15 is introduced into a buffer space 11*b* formed in the shower head 11 through the gas inlet line 14. The gas introduced into the shower head 11 is diffused in the shower head 11 and injected into the chamber C through a plurality of injection holes 11*a* formed in a bottom surface of the shower head 11.

A gas exhaust line 16 is provided at a bottom surface of the chamber C. A gas exhaust unit such as a TMP (turbo molecular pump) 20 or the like is connected to the gas exhaust line 16. The gas in the chamber C is exhausted by the operation of the TMP 20.

A high frequency electric field is generated between the mounting table 12 and the shower head 11 by the high frequency power supplied from the high frequency power supply 13 to the mounting table 12. The gas supplied into the chamber C through the injection holes 11*a* of the shower head 11 is turned into a plasma by the high frequency electric field generated between the mounting table 12 and the shower head 11. Predetermined processing such as etching, film formation or the like is performed on a surface of the semiconductor wafer W mounted on the mounting table 12 by active species contained in the plasma.

(Example of Configuration of TMP 20)

Figure 2:
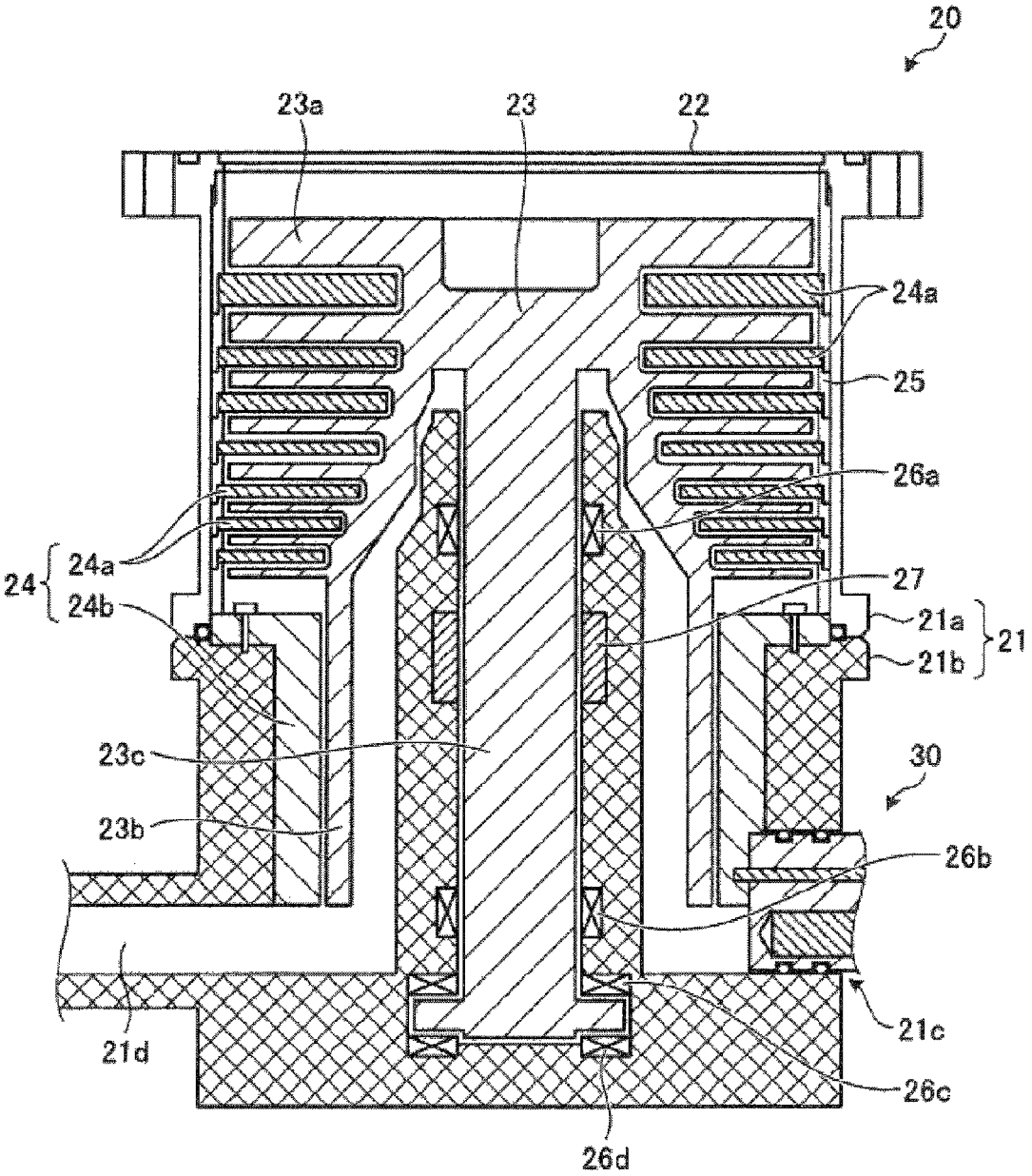
FIG. 2 shows an example of a TMP (turbo molecular pump)

FIG. 2 is a cross sectional view showing an example of the TMP 20. The TMP 20 includes a housing 21, a rotor 23, a stator 24, and a heating device 30. The housing 21 has an upper housing 21*a* and a lower housing 21*b*. The lower housing 21*b* is formed in a substantially cylindrical shape having a closed bottom and an open top. The upper housing 21*a* is formed in a substantially cylindrical shape and connected to an upper end of the lower housing 21*b*. An opening serving as an intake port 22 is formed at an upper portion of the upper housing 21*a*. The upper housing 21*a* and the lower housing 21*b* are made of, e.g., aluminum, stainless steel or the like.

The rotor 23 includes rotary blades 23*a*, a cylindrical portion 23*b*, and a rotor shaft 23*c*. The rotor shaft 23*c* is rotatably supported by bearings 26*a* to 26*d*. The bearings 26*a* and 26*b* support the rotor shaft 23*c* in a non-contact state by, e.g., magnetic force, in a direction intersecting with a rotation axis of the rotor shaft 23*c*. The bearings 26*c* and 26*d* support the rotor shaft 23*c* in a non-contact state by, e.g., magnetic force, in a direction along the rotation axis of the rotor shaft 23*c*. The rotary blades 23*a* are provided in multiple stages at the rotor shaft 23*c* on the side of the intake port 22. Each of the rotary blades 23*a* extends from the rotor shaft 23*c* in a radial direction about the rotation axis of the rotor shaft 23*c*. The cylindrical portion 23*b* is provided below the rotary blades 23*a*.

The stator 24 includes stationery blades 24*a* and a screw stator 24*b*. The stationery blades 24*a* are provided in multiple stages and are arranged alternately with the rotary blades 23*a* of the rotor 23. The stationery blades 24*a* of the respective stages are accommodated in the upper housing 21*a* with spacers 25 inserted therebetween. The screw stator 24*b* is disposed to face the cylindrical portion 23*b* of the rotor 23 to surround the cylindrical portion 23*b*. Screw grooves are formed at a surface of the screw stator 24*b*, which faces the cylindrical portion 23*b*. The screw stator 24*b* is fixed to the lower housing 21*b* by screws or the like. The screw stator 24*b* is an example of the component in the TMP 20.

A motor 27 rotates the rotor shaft 23*c*. Due to high-speed rotation of the rotor shaft 23*c* by the motor 27, a gas is sucked through the intake port 22 provided at the upper housing 21*a*, and molecules of the gas are bounced downward by the rotary blades 23*a* and the stationery blades 24*a*. The gas is compressed in the cylindrical portion 23*b* and the screw stator 24*b* and exhausted through the gas exhaust line 21*d* provided at a lower portion of the lower housing 21*b*.

An opening 21*c* is formed at a lower portion of a sidewall of the lower housing 21*b*. The heating device 30 is provided in the opening 21*c*.

(Example of Configuration of Heating Device 30)

Figure 3:
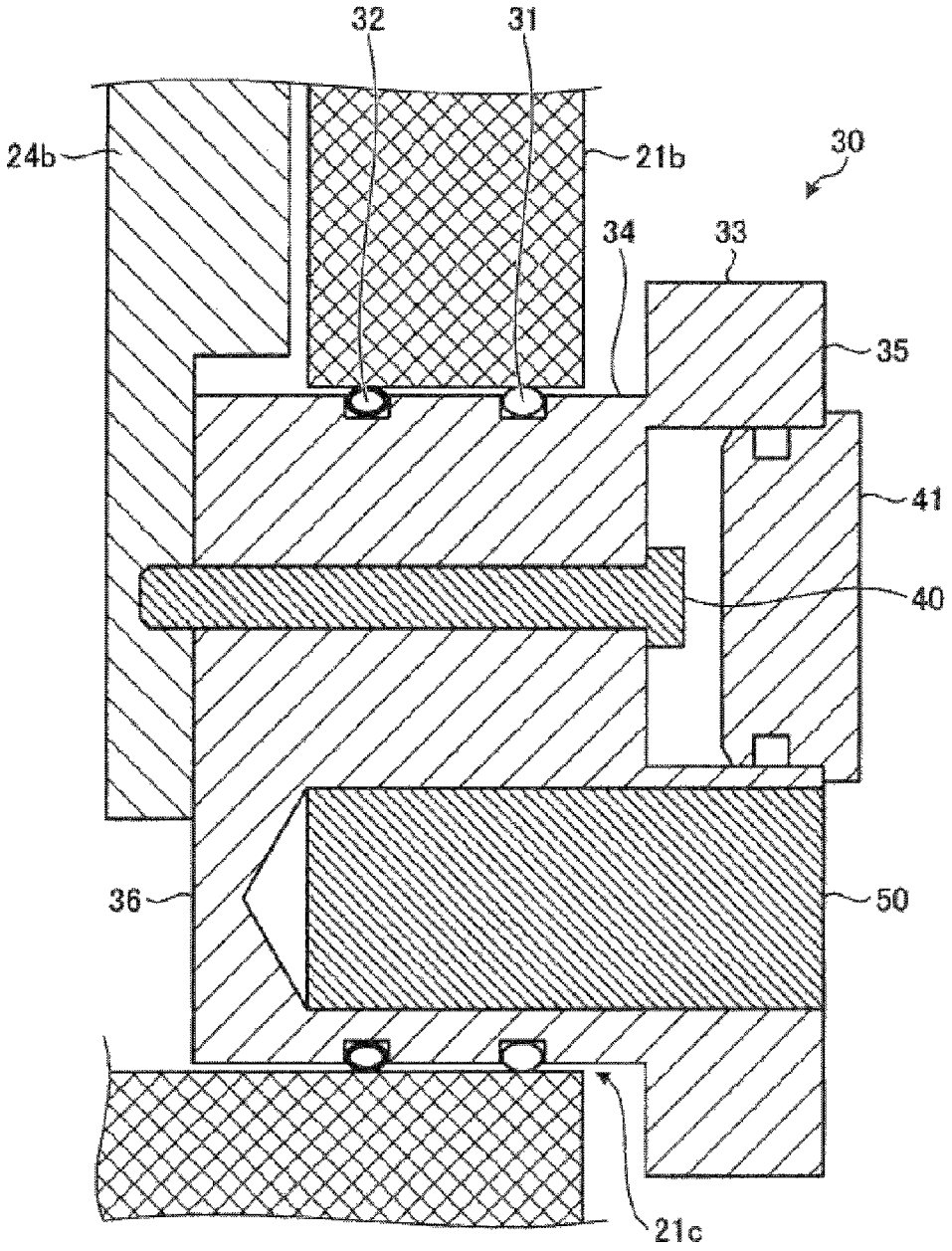
FIG. 3 shows an example of a heating device.
Figure 4:
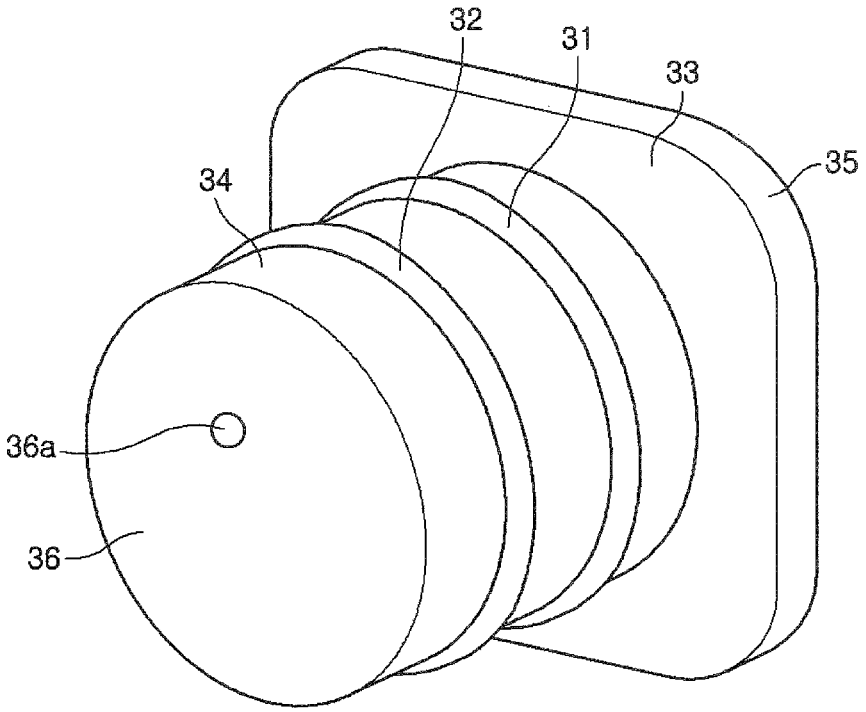
FIG. 4 is a perspective view showing an example of a heat transfer member provided with an O-ring and a radical trap ring.

FIG. 3 is an enlarged cross sectional view showing an example of the heating device 30. FIG. 4 is a perspective view showing an example of a heat transfer member provided with an O-ring and a radical trap ring. The heating device 30 has a heat transfer member 33. For example, as shown in FIG. 3, the heat transfer member 33 has one end fixed to the screw stator 24*b* and the other end exposed to the outside of the lower housing 21*b*. The heat transfer member 33 is made of a metal such as aluminum or the like which has high thermal conductivity. The heat transfer member 33 includes a substantially cylindrical part 34 and a flange 35.

For example, as shown in FIG. 4, a screw hole 36*a* into which a screw 40 is inserted is formed at an end surface 36 of the cylindrical part 34. For example, as shown in FIG. 3, the end surface 36 of the cylindrical part 34 is fixed to a lower portion of the screw stator 24*b* by a screw 40. An opening of the heat transfer member 33 into which the screw 40 is inserted is blocked by a cap 41.

A heater 50 is provided in the heat transfer member 33. The heater 50 radiates heat in response to instruction from a control unit (not shown). The heat radiated by the heater 50 is transferred to the screw stator 24*b* from the end surface 36 of the cylindrical part 34 through the heat transfer member 33. Accordingly, the screw stator 24*b* is heated to a predetermined temperature and the adhesion of deposits to the screw stator 24*b* is suppressed.

In the present embodiment, the lower housing 21*b* is controlled to a temperature lower than the temperature of the screw stator 24*b*. Therefore, in order to prevent the heat radiated by the heating device 30 from being transferred to the lower housing 21*b*, a gap is provided between the heat transfer member 33 and the lower housing 21*b* in a state where the screw stator 24*b* is heated by the heating device 30. The gap is sealed by an O-ring 31 in order to maintain airtightness in the TMP 20. For example, as shown in FIG. 4, the O-ring 31 is disposed in an annular shape between the heat transfer member 33 and the opening 21*c* of the lower housing 21*b* along an outer peripheral surface of the heat transfer member 33. The O-ring 31 is made of, e.g., vinylidene fluoride-based fluoroelastomer. The O-ring 31 is an example of a first seal member.

When a width of a gap between an outer peripheral surface of the cylindrical part 34 and an inner peripheral surface of the opening 21*c* varies depending on locations due to an assembly error or a dimensional error of the heating device 30, a gas in the TMP 20 easily flows into the gap in a location where the width of the gap is large. The gas that is exhausted while the plasma processing is being performed by the plasma processing apparatus 10 contains radicals. When the radicals collide with the O-ring 31, the O-ring 31 is corroded.

When the O-ring is corroded, the airtightness of the TMP 20 deteriorates and a predetermined exhaust performance cannot be obtained. Therefore, the O-ring is exchanged before the O-ring is corroded. In order to exchange the O-ring, it is required to stop the plasma processing apparatus and separate the TMP 20. When the plasma processing apparatus 10 is stopped, the throughput of the processing of the semiconductor wafer W is decreased. In addition, an O-ring made of a material having high resistance to radicals may be used. Since, however, such an O-ring is expensive, the entire cost of the TMP 20 is increased.

Therefore, in the present embodiment, a radical trap ring 32 is provided between the heat transfer member 33 and the opening 21*c* of the lower housing 21*b* and located close to the screw stator 24*b* compared to the O-ring 31. The radical trap ring 32 is provided in an annular shape along the outer peripheral surface of the heat transfer member 33. Due to the presence of the radical trap ring 32, movement of radicals contained in the gas exhausted by the TMP 20 into the space between the heat transfer member 33 and the opening 21*c* of the lower housing 21*b* is suppressed. In the present embodiment, the radical trap ring 32 has a surface coated with, e.g., fluorine resin. The fluorine resin coated on an O-ring of the radical trap ring 32 may be, e.g., polytetrafluoroethylene or the like.

In the radical trap ring 32 of the present embodiment, the fluorine resin coated on the O-ring has a thickness of, e.g., 0.2 mm to 0.4 mm for the O-ring having a cross sectional diameter of, e.g., 1.5 mm to 2.5 mm. Specifically, the radical trap ring 32 may be obtained by coating on a surface of an O-ring having a cross sectional diameter of, e.g., 2 mm, fluorine resin with a thickness of 0.3 mm. The radical trap ring 32 is an example of a second seal member.

The surface of the radical trap ring 32 is coated with fluorine resin and, thus, the inner O-ring, i.e., the radical trap ring 32, is not corroded by radicals even if the radical trap ring 32 is exposed to an atmosphere containing radicals. Since, however, the surface of the radical trap ring 32 is coated with fluorine resin, the seal performance thereof is poorer than that of the O-ring 31 having a surface that is not coated with fluorine resin. Therefore, in the present embodiment, in order to maintain the airtightness in the TMP 20, the O-ring 31 is provided, in addition to the radical trap ring 32, at the gap between the cylindrical part 34 and the lower housing 21*b*.

Figure 5:
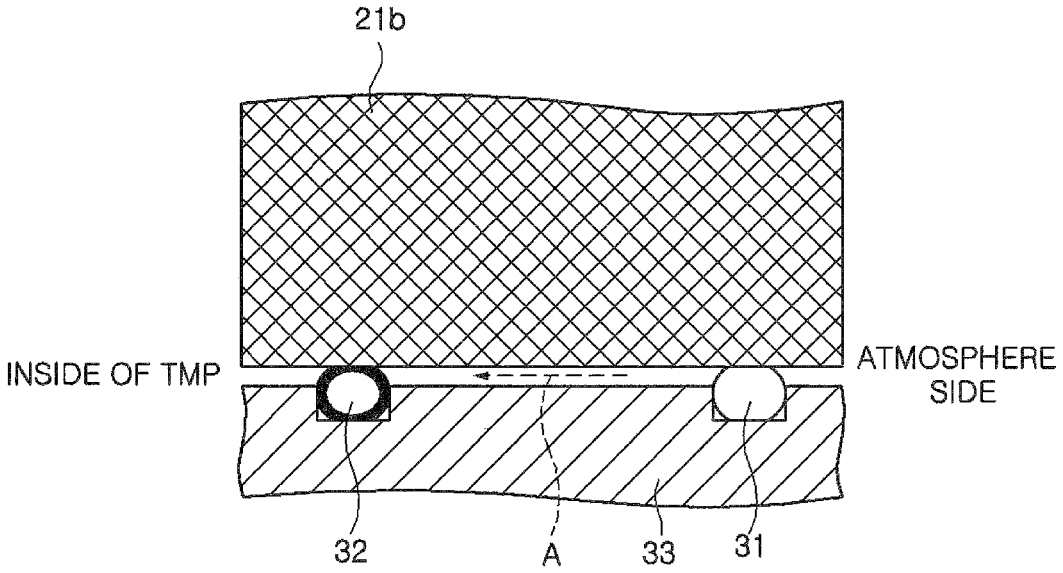
FIG. 5 explains an example of gas flow between a lower housing and the heat transfer member.

Since the sealing performance of the radical trap ring 32 is poorer than that of the O-ring 31, a small amount of gas in the TMP 20 may flow into the gap between the lower housing 21*b* and the heat transfer member 33. The outside of the TMP 20 is in an atmospheric pressure, and a pressure in the TMP 20 is considerably lower than an atmospheric pressure. Although the sealing performance of the O-ring 31 is better than that of the radical trap ring 32, the O-ring 31 cannot completely prevent leakage and a small amount of gas flows into the TMP 20 from the outside. Therefore, gas flow directed from the O-ring 31 toward the radical trap ring 32 is generated in the gap between the lower housing 21*b* and the cylindrical part 34, as indicated by, e.g., a dotted arrow A in FIG. 5.

Accordingly, the gas leaked from the inside of the TMP 20 to the gap between the lower housing 21*b* and the heat transfer member 33 through the radical trap ring 32 is pushed back toward the radical trap ring 32 by the gas flow generated in the gap between the lower housing 21*b* and the heat transfer member 33. As a consequence, the gas leaked from the inside of the TMP 20 to the gap between the lower housing 21*b* and the heat transfer member 33 through the radical trap ring 32 returns into the TMP 20 through the radical trap ring 32 without reaching the O-ring 31. Thus, radicals contained in the gas leaked from the inside of the TMP 20 to the gap between the lower housing 21*b* and the heat transfer member 33 through the radical trap ring 32 return to the inside of the TMP 20 through the radical trap ring 32 without reaching the O-ring 31. As a result, the radical trap ring 32 can suppress corrosion of the O-ring 31 due to radicals contained in the gas flowing through the TMP 20.

As a distance between the radical trap ring 32 and the O-ring 31 increases, it is more difficult for the gas leaked from the inside of the TMP 20 to the gap between the lower housing 21*b* and the heat transfer member 33 through the radical trap ring 32 to reach the O-ring 31. Therefore, in order to suppress corrosion of the O-ring 31 due to radicals, it is preferable to increase the distance between the radical trap ring 32 and the O-ring 31.

The embodiment of the TMP 20 has been described. By using the TMP 20 of the present embodiment, the throughput of the semiconductor wafer W manufacturing process can be improved.

(Other Applications)

The disclosure is not limited to the above embodiment and may be variously modified within the scope of the gist thereof.

For example, in the above embodiment, one radical trap ring 32 is provided along the outer peripheral surface of the cylindrical part 34 of the heat transfer member 33 of the heating device 30. However, there may be provided a plurality of radical trap rings 32. In that case as well, the radical trap rings 32 are provided between the heat transfer member 33 and the opening 21*c* of the lower housing 21*b* and located close to the screw stator 24*b* compared to the O-ring 31. Accordingly, the amount of the gas leaked from the inside of the TMP 20 to the gap between the lower housing 21*b* and the heat transfer member 33 is reduced, which makes it possible to further reduce the amount of radicals that reach the O-ring 31.

Figure 6:
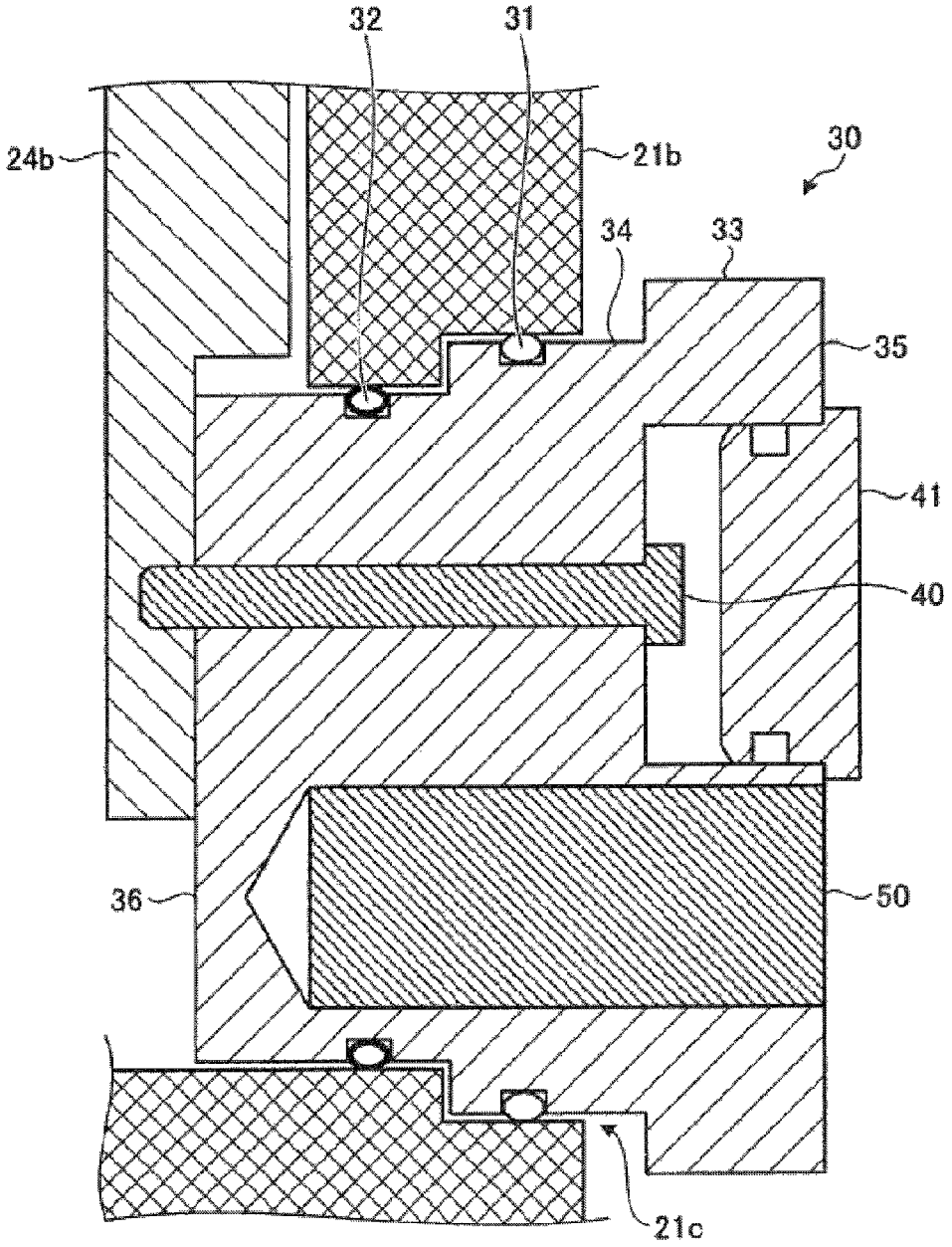
FIG. 6 is an enlarged cross sectional view showing another example of the heating device.

In the above embodiment, there is no stepped portion other than the grooves for accommodating the O-ring 31 and the radical trap ring 32 at the outer peripheral surface of the cylindrical part 34 of the heat transfer member 33. However, the disclosure is not limited thereto. For example, as shown in FIG. 6, a stepped portion may be formed at the outer peripheral surface of the cylindrical part 34 of the heat transfer member 33 such that a diameter increases in a stepwise manner from the end surface 36 side toward the flange 35 side. Accordingly, the radicals contained in the gas leaked from the inside of the TMP 20 to the gap between the lower housing 21*b* and the cylindrical part 34 are deactivated by repeated collision with the lower housing 21*b* or the cylindrical part 34 while passing through the gap between the lower housing 21*b* and the cylindrical part 34. As a consequence, it is possible to prevent the radicals contained in the gas leaked from the inside of the TMP 20 to the gap between the lower housing 21*b* and the cylindrical part 34 from reaching the O-ring 31 with high energy. As a result, the deterioration of the O-ring 31 can be further suppressed. In FIG. 6, a single stepped portion is provided at the outer peripheral surface of the cylindrical part 34. However, two or more stepped portions may be provided at the outer peripheral surface of the cylindrical part 34.

In the above embodiment, the radical trap ring 32 is provided at the gap between the lower housing 21*b* of the TMP 20 and the heating device 30. However, the disclosure is not limited thereto. For example, the radical trap ring 32 may be provided near an O-ring provided in the gap, into which radicals may flow, between the components in the plasma processing apparatus 10. For example, in the gap between the components into which the radicals may enter, the radical trap ring 32 is provided between the O-ring and a space through which the gas containing radicals flows. Accordingly, it is possible to suppress deterioration of the O-ring used in the plasma processing apparatus 10 due to radicals.

While the disclosure has been shown and described with respect to the embodiments, it will be understood by those skilled in the art that various changes and modifications may be made without departing from the scope of the disclosure as defined in the following claims.

What is claimed is:

1. A heating device for heating a component in a turbo molecular pump for exhausting a gas in a plasma processing apparatus, the heating device comprising:

a heat transfer member having a cylindrical part;

a heater provided in the heat transfer member, and configured to heat the component through the heat transfer member;

a first seal member provided in an annular shape along an outer peripheral surface of the cylindrical part of the heat transfer member; and a second seal member provided in an annular shape along the outer peripheral surface of the cylindrical part of the heat transfer member and located close to the component compared to the first seal member, wherein the second seal member is configured to suppress movement of radicals contained in a gas exhausted by the turbo molecular pump, wherein the second seal member has a surface coated with fluorine resin while a surface of the first seal member is not coated with fluorine resin, wherein the cylindrical part includes a first portion and a second portion, a diameter of the first portion being larger than a diameter of the second portion such that a stepped portion is formed at the outer peripheral surface of the cylindrical part, and the first portion is farther from the component than the second portion, and wherein the first seal member is provided along an outer peripheral surface of the first portion.

2. The heating device of claim 1, wherein the second seal member is an O-ring.

3. The heating device of claim 2, wherein the fluorine resin coated on the surface of the O-ring is polytetrafluoroethylene.

4. The heating device of claim 2, wherein the fluorine resin is coated on the surface of the O-ring with a thickness of 0.2 mm to 0.4 mm.

5. The heating device of claim 1, wherein the second seal member comprises a plurality of sealing rings at multiple locations close to the component compared to the first seal member.

6. The heating device of claim 1, wherein the component is a screw stator in the turbo molecular pump.

* * * * *